US005362203A

United States Patent [19]

Brasz

[11] Patent Number: 5,362,203

[45] Date of Patent: Nov. 8, 1994

[54] MULTIPLE STAGE CENTRIFUGAL COMPRESSOR

[75] Inventor: Joost J. Brasz, Fayetteville, N.Y.

[73] Assignee: Lamson Corporation, Syracuse, N.Y.

[21] Appl. No.: 143,620

[22] Filed: Nov. 1, 1993

[51] Int. Cl.[5] ..... F01D 9/04

[52] U.S. Cl. ..... 415/199.1; 415/187; 415/188; 415/199.2; 415/211.1

[58] Field of Search ..... 415/186, 187, 188, 199.1, 415/199.2, 199.3, 208.1, 208.2, 208.3, 211.1, 211.2, 914; 416/180, 197 C

[56] References Cited

U.S. PATENT DOCUMENTS

| | | | |
|---|---|---|---|
| 2,305,136 | 12/1942 | Campbell | 415/188 |
| 2,641,191 | 6/1953 | Buchi | 415/188 |
| 2,748,713 | 6/1956 | Buchi | 415/188 |
| 2,799,228 | 7/1957 | Farrell | 416/180 |
| 2,888,809 | 6/1959 | Rachfal . | |
| 3,081,604 | 3/1963 | Namisniak . | |
| 3,362,625 | 1/1968 | Endress . | |
| 3,954,430 | 5/1976 | Curtis . | |
| 3,976,395 | 8/1976 | Kalnin . | |
| 4,149,585 | 4/1979 | Sterlini . | |
| 4,262,488 | 4/1981 | Conine . | |
| 4,429,540 | 2/1984 | Burnham . | |
| 4,646,530 | 3/1987 | Huenniger . | |
| 4,887,940 | 12/1989 | Todoroki et al. | 415/199.1 |
| 4,989,403 | 2/1991 | Rodgers . | |
| 5,077,967 | 1/1992 | Widener et al. | 415/211.2 |
| 5,135,368 | 8/1992 | Amin . | |

*Primary Examiner*—Edward K. Look
*Assistant Examiner*—Christopher Verdier
*Attorney, Agent, or Firm*—Harris Beach & Wilcox

[57] ABSTRACT

A multiple stage centrifugal compressor has baffle rings attached at the inlet to each of the impellers, between a shroud side curvature and a hub side curvature. The dimensions and spacings of the baffle rings are selected as a function of the shroud side radius of curvature $R_S$ and the hub side radius of curvature $R_H$. For two baffle rings, the radii are $$R_{C1}=(R_c^2\times R_H)^{\frac{1}{3}} \text{ and } R_{C2}=(R_S\times R_H^2)^{\frac{1}{3}}.$$

5 Claims, 4 Drawing Sheets

MULTIPLE STAGE CENTRIFUGAL COMPRESSOR

BACKGROUND OF THE INVENTION

This invention relates to compressors and blowers, especially those intended for supplying generous quantities of air at moderate pressures such as one to two atmospheres above ambient.

The invention is particularly related to an improvement in multiple stage centrifugal compressors.

Centrifugal compressors are well known and have been employed in a variety of applications. For example, centrifugal compressors are described in U.S. Pat. No. 4,646,530; U.S. Pat. No. 4,262,988; U.S. Pat. No. 2,888,809; and U.S. Pat. No. 3,362,625. A multiple stage centrifugal compressor is described in U.S. Pat. No. 4,429,540. Another multiple stage centrifugal compressor is described in U.S. Pat. No. 3,976,395.

In any typical centrifugal compressor, gas is introduced to a rotary impeller which drives the gas outward at high velocity through a radial compression channel into an annular diffusion chamber. In this chamber, the velocity of the gas drops and its pressure increases. That is, the velocity (kinetic energy of the gas) is converted into pressure (potential energy). In a single-stage unit, the compressed gas can be drawn off from the diffusion chamber. However, in a multiple stage compressor, the compressed gas continues from the diffusion chamber into a radial return channel, where the gas is led radially inward to feed the next stage. An inlet passage turns this flow of return compressed gas between 90 degrees and 180 degrees to introduce a flow of compressed gas to the impeller of the next stage, where the process is repeated.

At the inlet passage, the gas turns around a small radius on the radially outer, or shroud side, and around a large radius at the radially inner, or hub side. The small radius of curvature of the gas passage at the shroud side for the relatively wide passage area (due to the much larger radius of curvature on the hub side) leads to flow separation. At the high velocities experienced in compressor operation, this flow separation results in substantial performance degradation, because of pressure loss and efficiency reduction.

In existing multiple stage blowers of this type, a single baffle ring is installed in the inlet passage, positioned somewhat closer to the shroud than to the hub. The exact location of the ring has not been regarded as critical. The object of the baffle ring has been to prevent flow separation where the moving air flow has to make a sharp 180 degree bend from the return channel to the impeller of the next stage.

Testing of the conventional baffle ring configuration has revealed a measurable improvement of efficiency. A single baffle ring installed somewhat closer to the shroud than to the hub has been found to increase the overall blower efficiency by about eight percent over the same unit without the baffle ring. However, additional baffle rings did not improve the efficiency. It was tried to produce higher efficiency by installing a second baffle ring between the first baffle ring and the hub contour, thus roughly equalizing the spacings for the three resulting flow subchannels. However, this configuration caused a *reduction* in performance by two percent compared with the single baffle ring unit.

In other words, increasing the blower efficiency and performance was not simply a matter of installing baffle rings, because it was not previously appreciated how significant were the spacings of the baffle rings and the dimensions of the resulting flow subchannels.

OBJECTS AND SUMMARY OF THE INVENTION

It is an object of this invention to provide a multiple stage centrifugal compressor whose efficiency and performance are improved over the compressors of the prior art.

It is a more specific object of the invention to provide a compressor with baffle rings at the inlet to each stage, where the location and geometry of the baffle rings are selected to create a minimum of flow separation at this location.

According to an aspect of this invention an integral number N baffle rings are disposed in the inlet passage of each stage at the entrance to the compression channel for the next successive stage, i.e., where the next stage impeller is located. The N baffle rings are situated between the shroud side contour and the hub side contour at this bend to divide the flow into N+1 subchannels. The baffle rings have their respective sizes and spacings arranged so that each of the N+1 subchannels has substantially the same pressure differential across it in the through-flow direction.

The inlet passage has a shroud side curve radius $R_S$ measured from a toroidal core axis and a hub side curve radius $R_H$ taken from the same toroidal core axis. For a single baffle ring, i.e., N=1, the baffle ring is spaced at a radius $R_1=(R_S \times R_H)^{\frac{1}{2}}$. For two baffle rings, the rings should be spaced respectively at radii $$R_1=(R_S^2 \times R_H)^{\frac{1}{3}} \text{and}$$

$$R_2=(R_S \times R_H^2)^{\frac{1}{3}}$$

Generally, for N baffle rings the baffle rings should have radii $$R_k = (R_S^k \times R_H^{N+1-k})^{\frac{1}{N+1}}$$

Where k is an integer: 1, 2,. . N.

Each baffle ring should also have a toroidal contour bending between about 90° and 180° around the inlet passage.

The reasoning for this configuration of baffle rings is to maintain an even pressure differential at the bend, so there is even flow of gas into the impeller. The previous arrangements created or permitted uneven pressure drops in each subchannel, producing uneven flow and contributing to a loss in efficiency. However, the present invention derives from an analysis based on the number of baffle rings and the radii of curvature of the shroud and hub contours. The resulting baffle geometry is independent of flow rate, and will benefit compressors over a wide range of flow rates.

The baffle ring configuration creates spacings such that equal losses arise in the various parallel flow channels. The width of each channel between successive baffle rings is proportional to the radius of curvature of the main streamline of that channel. As a result the spacings of flow channels closer to the hub are significantly greater than those of the flow channels closer to the shroud.

Testing of two and three baffle ring arrangements, following the geometry prescribed by this invention, shows additional performance improvements of 2.5 percent and 3.5 percent, respectively, over the single baffle arrangement.

The theory of this invention can be explained from what is known concerning pressure losses in elbows and pipe bends. This pressure loss occurs because there is a difference in flow velocity between the inside of the turn and the outside of the turn. For example, equidistant spacing of the baffle rings produces a greater pressure differential in the shroud-side channels than in the hub-side channels. This produces a higher flow velocity in the hub-side channels and a lower flow velocity in the shroud-side channels. This means that the meridional flow entering the impeller is distorted, and this produces a reduction in efficiency.

However, it has been observed that the through-flow pressure loss in a bend or elbow is proportional to the maximal radial pressure difference in each subchannel of flow around the elbow. For the blower or compressor stage inlet, each section or subchannel has a radial pressure difference ΔP:

$$\Delta P = \Delta R \frac{dp}{dr}$$

$$= \Delta R \rho \frac{V_m^2}{Rc}$$

$$= \frac{W}{R_c} \rho V_m^2$$

Where ΔR or W is the flow channel width, ΔP is the radial pressure differential, $V_m$ is gas through-flow velocity, $R_C$ is radius of curvature of the baffle ring, and $\rho$ is the gas density.

The spacing between successive baffles and between the baffles and the hub and shroud should be designed to keep the radial pressure differences the same from one channel to the next. This means that the spacing should be designed to be a function of the radius of curvature of the main streamline of the respective channel.

Following this requirement, equations can be derived for optimum location of inlet baffles. Given $R_S$ and $R_H$ (radius of curvature at the shroud and at the hub respectively at the impeller inlet) the radius of curvature for one, two, three and N baffles are as follows:

$$\text{One baffle} = R_c = \sqrt{R_S \times R_H}$$

$$\text{Two baffles:} \quad R_{C1} = \sqrt[3]{R_S^2 \times R_H}$$

$$R_{C2} = \sqrt[3]{R_S \times R_H^2}$$

$$\text{Three baffles:} \quad R_{C1} = \sqrt[4]{R_S^3 \times R_H}$$

$$R_{C2} = \sqrt[4]{R_S^2 \times R_H^2}$$

$$R_{C2} = \sqrt[4]{R_S \times R_H^3}$$

-continued $$N \text{ Baffles} \quad R_{C1} = \sqrt[N+1]{R_S^N \times R_H}$$

$$R_{C2} = \sqrt[N+1]{R_S^{N-1} \times R_H^2}$$

$$\cdots$$

$$R_{Ck} = \sqrt[N+1]{R_S^{N-k+1} \times R_H^k}$$

$$\cdots$$

$$R_{CN} = \sqrt[N+1]{R_S \times R_H^N}$$

As one particular example; if we assume shroud side radial $R_S$ and hub side radial $R_H$ such that $R_S$=0.375 inches and $R_H$=5 inches, the following radii of curvature can be calculated for 1, 2, 3 and 4 baffles:

1 baffles: $R_{C1}$ = 1.37 inches 2 baffles: $R_{C1}$ = 0.89 inches
$R_{C2}$ = 2.11 inches 3 baffles: $R_{C1}$ = 0.72 inches
$R_{C2}$ = 1.37 inches
$R_{C3}$ = 2.62 inches 4 baffles: $R_{C1}$ = 0.63 inches
$R_{C2}$ = 1.06 inches
$R_{C3}$ = 1.77 inches
$R_{C4}$ = 2.98 inches The above and many other objects, features, and advantages of this invention will present themselves to persons skilled in the art from the ensuing description of selected preferred embodiments, which should be considered in conjunction with the accompanying Drawing.

DETAILED DESCRIPTION OF THE PREFERRED EMBODIMENTS

Figure 1:
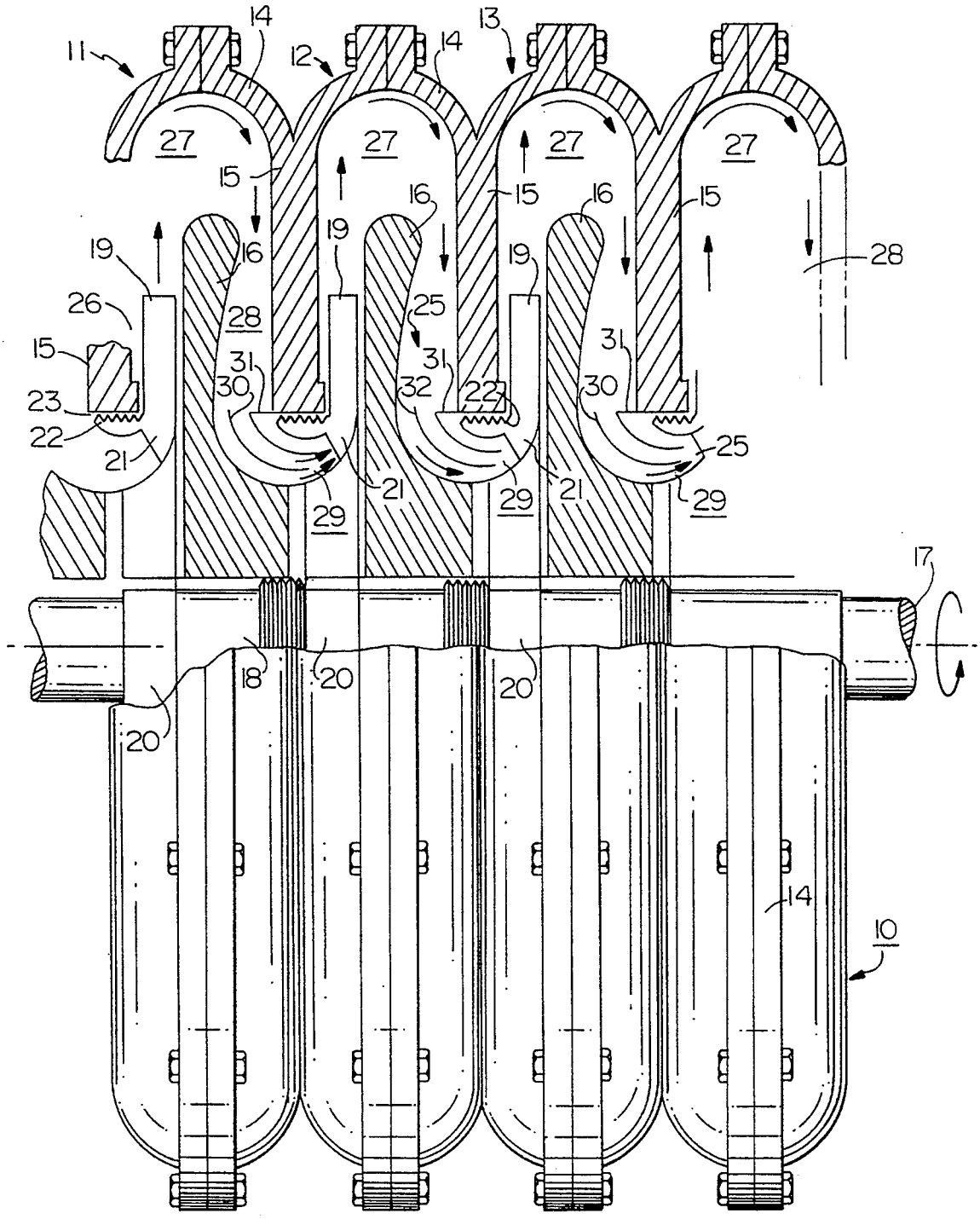
FIG. 1 is a sectional view of a multiple stage centrifugal compressor according to one preferred embodiment of the invention.

With reference now to the Drawing, FIG. 1 shows a portion of a centrifugal blower or compressor 10 partly cut away and in section with successive stages 11, 12, and 13. Of course, there can be stages in advance of stage 11 and other stages after stage 13, but what is shown is intended to be representative of the system in which the inventive structure resides.

A static portion of the blower 10 is formed by a shell or shroud 14, here formed as a stack or series of shroud members fastened in series, each having an outer housing portion 15 and a diaphragm 16. The blower also has a rotor 17 in which a rotary shaft 18 supports a series of rotary impellers 19. Each impeller has a hub portion 20 of arcuate cross section and a row of blades 21. A shroud-side ring 22 is affixed on the blades 21 at an entrance side and has a sequence of annular serrations that face the shroud to form a dynamic gas seal 23.

The spinning impellers 19 drive the gas along a respective pathway 25 within each of the successive stages 11, 12, 13, etc. Each gas pathway 25 has a compression channel 26 where the impeller blades 21 perform work on the gas and drive it radially outward to a diffusion chamber 27 located at a radially outermost region of the interior of the housing portion 15. Here the kinetic energy of the gas (its velocity) is converted to pressure. On a return-flow side of the diaphragm 16 a return channel 28 leads radially inward to conduct the compressed gas from the diffusion chamber 27 back toward the hub. Here the diaphragm curves to form an inlet portion 29 where the gas flow bends to a radially outward direction as it enters the impeller 19 of the next stage 12, 13, etc. in succession.

Figure 2:
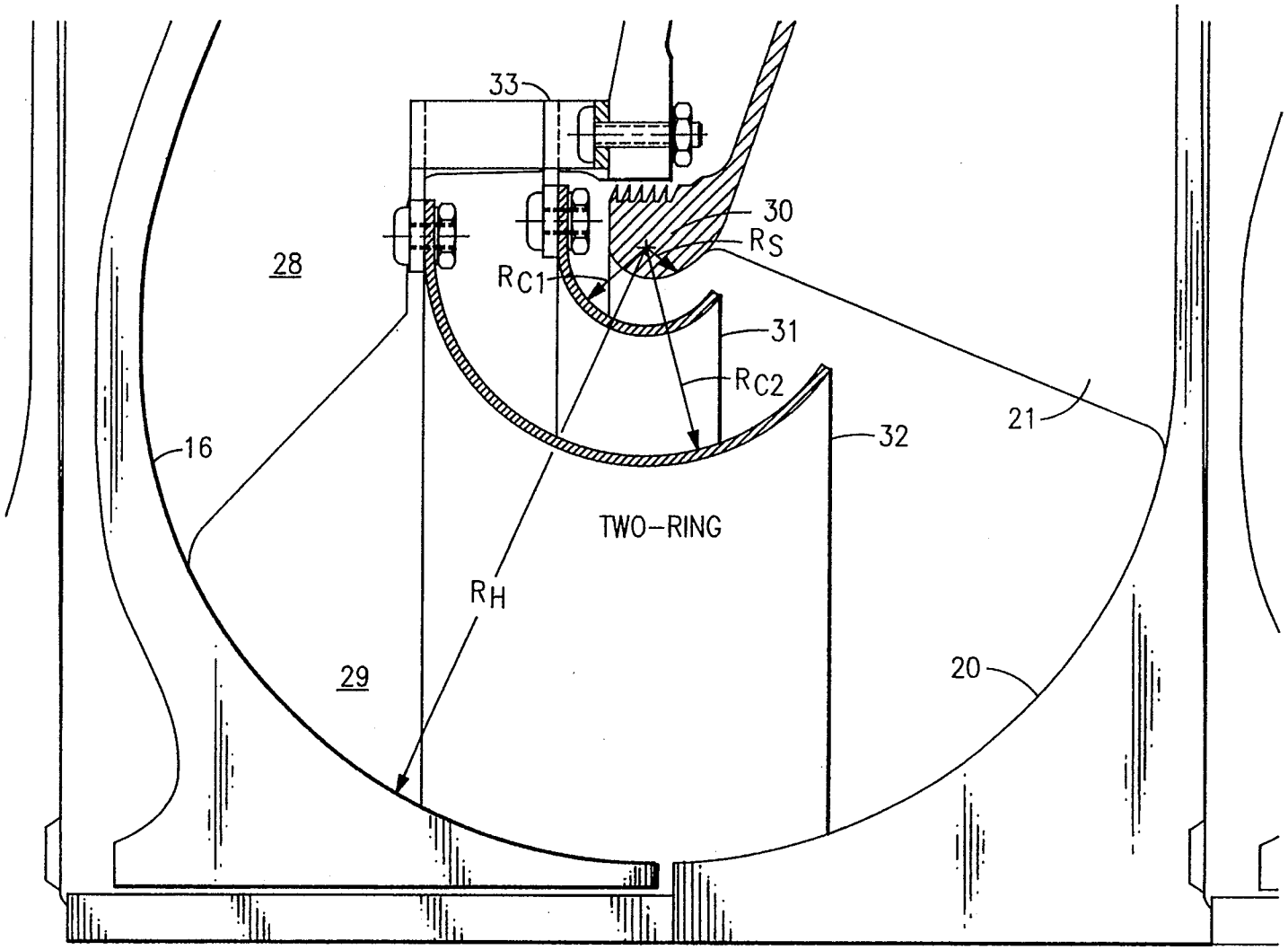
FIGS. 2, 3, and 4 are detailed sectional views showing the inlet portion between successive stages of the compressor, and having two baffle rings, a single baffle ring, and three baffle rings, respectively.

The ring 22, as shown better in FIG. 2, on the shroud side of the inlet portion has an arcuate cross section with a radius of curvature $R_S$ about a ring axis 30 that extends around the entire inlet portion 29.

In this embodiment there are a pair of ring baffles 31 and 32 mounted to the shroud on mounting devices 33. These ring baffles 31, 32 are toroidal in shape and extend continuously around the axis of the blower 10, each having a toroidal contour of radius $R_{C1}$ and $R_{C2}$, respectively.

The toroidal contours continue between 90 degrees and 180 degrees of arc around the center of curvature 30, here about 135 degrees.

The curved contour of the diaphragm 16 and the curved contour of the hub 20 form the outer or hub side contour of the inlet portion, with the hub having a radius $R_H$ from the center of curvature 30.

In order to obtain optimal flow characteristics for the gas around the bend at the inlet portion 29, the radii $R_{C1}$, $R_{C2}$ at which the baffle rings 31, 32 are positioned are selected as discussed previously. In this case for two baffle rings these radii are determined based on the number of rings 31, 32 and the radii of curvature $R_S$, $R_H$ at the shroud side and at the hub side of the inlet portion.

The two rings have radii respectively computed $$R_{C1}=(R_S^2\times R_H)^{\frac{1}{3}}\text{and}$$

$$R_{C2}=(R_S\times R_H^2)^{\frac{1}{3}}.$$

As mentioned before this creates equal pressure drops for the three flow subchannels defined by the baffle rings 31 and 32.

Figure 3:
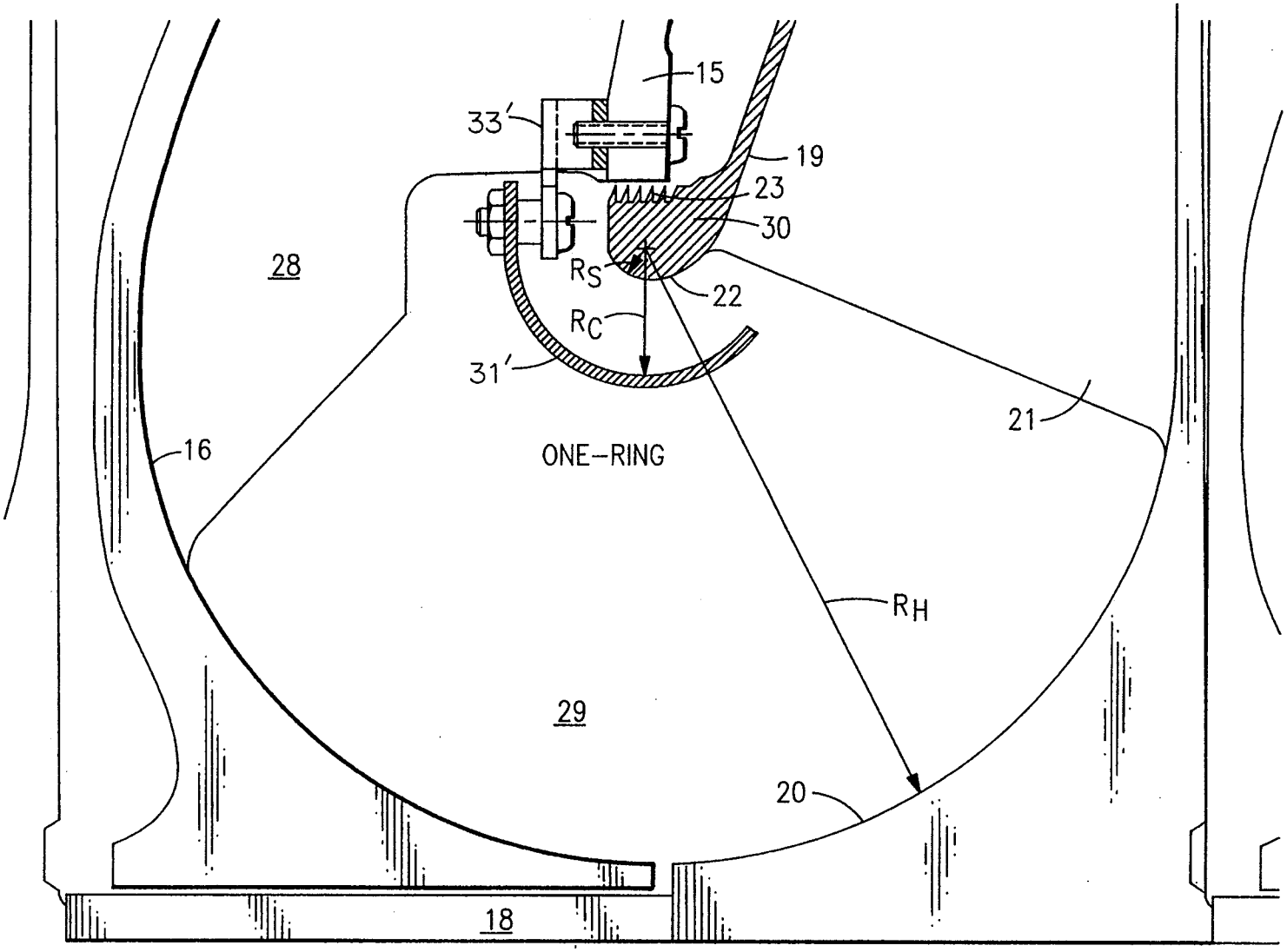

FIG. 3 shows a similar arrangement to that of FIGS. 1 and 2, except employing only a single baffle ring 31' at a radius $R_C$ from the center of curvature 30. The remaining elements shown here that are identical with those of FIG. 2 are identified with the same reference numerals, and need not be discussed in detail. A smaller mount 33' is used here for the single baffle ring 31'. The baffle ring radius $R_C$ is calculated as a function of the radii $R_S$ and $R_H$ to be $$R_C=(R_S\times R_H)^{\frac{1}{2}}.$$

Figure 4:
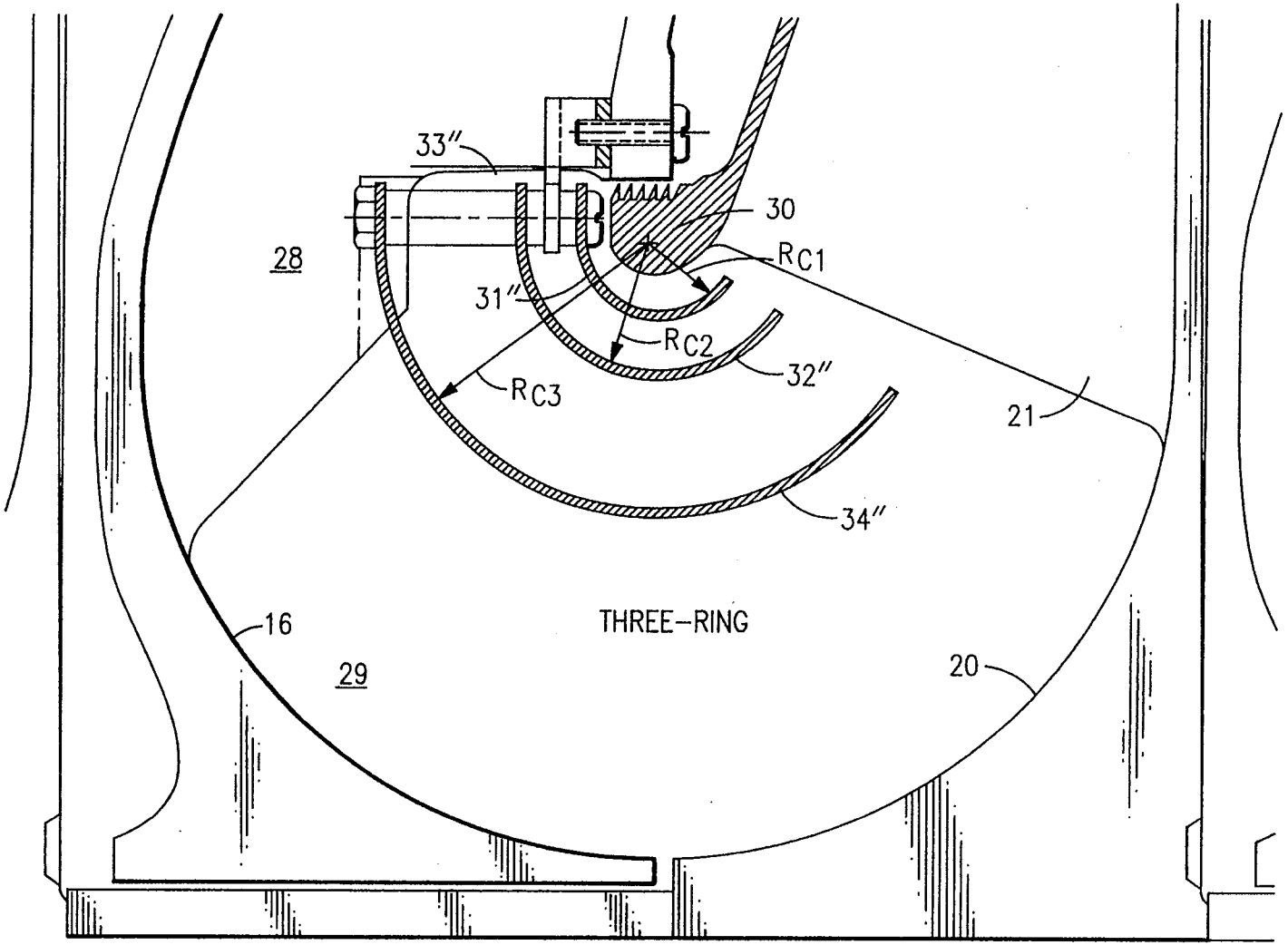

FIG. 4 shows a three-ring version which is otherwise identical to the embodiments of FIGS. 1 to 3, and the same elements are identified with like reference numerals. Here there are three baffle rings 31'', 32'' and 34'', shown attached by a mount 33'', and with successively larger radii of curvature $R_{C1}$, $R_{C2}$, and $R_{C3}$, which are calculated based on the radii $R_S$ and $R_H$ as follows:

$$R_{C1}=(R_S^3\times R_H)^{\frac{1}{4}}$$

$$R_{C2}=(R_S^2\times R_H^2)^{\frac{1}{4}}\text{and}$$

$$R_{C3}=(R_S\times R_H^3)^{\frac{1}{4}}.$$

Here four subchannels are created in the inlet portion 29.

A very large compressor could accommodate four, five, or some higher number of ring baffles at the inlet to each stage. These N baffle rings would be configured to have respective radii of curvature $R_k$, $$R_k = (R_S^{N-k+1} \times R_H^k)^{\frac{1}{N+1}}$$

Where k is an integer between 1 and N.

Additional features can be incorporated into the centrifugal compressor to improve performance. For example, vanes can be installed in the return channels 28 to redirect the residual swirl component of gas flow. Also, the impeller can be shaped to obtain optimal diffusion, and to limit discharge velocity relative to inlet velocity. The shroud and hub design can also be configured over a wide range of design variables for optimal blower performance.

While this invention has been described with reference to a few selected preferred embodiments, it should be appreciated that these embodiments stand as examples, and that the invention is not limited to these precise embodiments. Rather, many modifications and variations will present themselves to persons skilled in this art without departing from the scope and spirit of this invention, as defined in the appended claims.

What is claimed is:

1. In a centrifugal compressor having a plurality of successive stages with a common shaft on which are positioned respective impellers, each having a hub and a series of impeller blades, and a stator portion that includes an outer shroud and a series of inner diaphragms, each said stage having a gas flow path defined between said shroud and said diaphragm, including a compression channel in which said impeller blades rotate to drive gas radially outward to a diffusion chamber in which centrifugal motion energy of the gas is converted into pressure, a return flow channel in which the compressed gas is directed radially inward back towards the shaft, and an inlet passage for bending the flow of gas from the return flow channel radially outward into the impeller of the next successive stage; the improvement which comprises N baffle rings disposed in said inlet passage at the entrance to the next successive compression channel for dividing the flow of gas therethrough into N+1 annular subchannels, where N is an integer equal to one or higher, the N baffle rings having their size and spacing arranged such that each of said N+1 subchannels has substantially the same pressure differential there across in the through-flow direction; and wherein said inlet passage is defined between a shroud side curve of radius $R_S$ and a hub side curve or radius $R_H$ taken from a curve center on the shroud side, and wherein said N baffle rings each are spaced from said curve center by a respective radius $R_k$ where k is an integer 1, 2, . . .N:

$$R_k = (R_S^{N-k+1} X R_H^K)^{\frac{1}{N+1}}.$$

2. The centrifugal compressor of claim 1 wherein there is a single said baffle ring spaced at a radius $R_1=(R_S \times R_H)^{\frac{1}{2}}$.

3. The centrifugal compressor of claim 1 wherein there are two said baffle rings spaced respectively at radii $$R_1=(R_S^2 \times R_H)^{\frac{1}{3}} \text{and}$$

$$R_2=(R_S \times R_H^2)^{\frac{1}{3}}.$$

4. The centrifugal compressor of claim 1 wherein there are three said baffle rings spaced respectively at radii $$R_1=(R_S^3 \times R_H)^{\frac{1}{4}}$$

$$R_2=(R_S^2 \times R_H^2)^{\frac{1}{4}}$$

$$R_3=(R_S \times R_H^3)^{\frac{1}{4}}.$$

5. The centrifugal compressor of claim 1 wherein each said baffle ring has toroidal curvatures and bends between 90° and 180° around said curve center at said inlet passage.

* * * * *